United States Patent [19]

Dilling

[11] 4,081,008

[45] Mar. 28, 1978

[54] LOG SPLITTER

[76] Inventor: Roy Dilling, P.O. Box 2024, Fitchburg, Mass. 01420

[21] Appl. No.: 679,477

[22] Filed: Apr. 22, 1976

[51] Int. Cl.[2] ..... B27L 7/00

[52] U.S. Cl. ..... 144/193 A; 144/3 K; 144/323; 214/77 P; 296/28 R

[58] Field of Search ..... 144/3 K, 309 R, 321, 144/193 R, 193 A, 193 B, 193 C, 193 D, 323; 296/28 R; 214/77 P

[56] References Cited

U.S. PATENT DOCUMENTS

| | | | |
|---|---|---|---|
| 1,425,298 | 8/1922 | Treat | 144/193 B |
| 1,626,152 | 4/1927 | Rasmussen | 144/193 B |
| 2,298,166 | 10/1942 | Richards | 214/77 P |
| 3,658,196 | 4/1972 | Schmitt | 214/77 P |
| 3,760,854 | 9/1973 | Worthington | 144/193 A |
| 3,779,295 | 12/1973 | Balsbaugh | 144/193 A |
| 3,938,567 | 2/1976 | Dircksen et al. | 144/193 A |
| 3,982,572 | 9/1976 | Kortendick | 144/193 B |

FOREIGN PATENT DOCUMENTS

| | | | |
|---|---|---|---|
| 210,512 | 3/1956 | Australia | 144/193 A |

*Primary Examiner*—Othell M. Simpson
*Assistant Examiner*—W. D. Bray
*Attorney, Agent, or Firm*—Charles R. Fay

[57] ABSTRACT

An upright free-standing log splitter operated by a vertical ram energized from any source desired such as a tractor to which the log splitter may be secured, or a trailer. The log splitter may be placed on a rear part of a truck or the like by means of parallel bars so that the splitter may be placed on the ground or raised for transportation. Wheels may be provided for the working platform or bed of the splitter so that it may be trailered.

3 Claims, 8 Drawing Figures

LOG SPLITTER

BACKGROUND OF THE INVENTION

There have been many log splitters suggested most of which provide a wedge type ax head and can be used to split relatively small logs only as for instance in a horizontal position, and it is the purpose of the present invention to provide a log splitter having a much greater capacity and which is very easily controlled and transported.

SUMMARY OF THE INVENTION

The present log splitter comprises a base or platform upon which the wood stump or section of log is to be placed while being split. A pair of relatively widely spaced channel irons facing each other are fixed in upright position on the base and these guide between them the splitter blade which comprises an elongated blade stretching between the two channel irons and backed up by relatively large triangular plates secured thereto, vertical sides of the triangular plates being received in the channels thereby stabilizing the blade in spite of its great length so that it will not bind in the channels regardless of pressures exerted.

An attachment is provided for mounting one of said channels onto a tractor so that the hydraulic system of the tractor can be used to power the splitter, but also one channel may be secured with respect to an upright member on a trailer which may have its own motorized pump for the purpose of operating the splitter. Also the basic unit may be mounted on swingable parallel bars as for instance on the rear of a truck and may be self-energized for lifting to and from the ground; the base being on the ground for operation and then lifted up onto the side of the truck for transportation.

PREFERRED EMBODIMENT OF THE INVENTION

Figure 1:
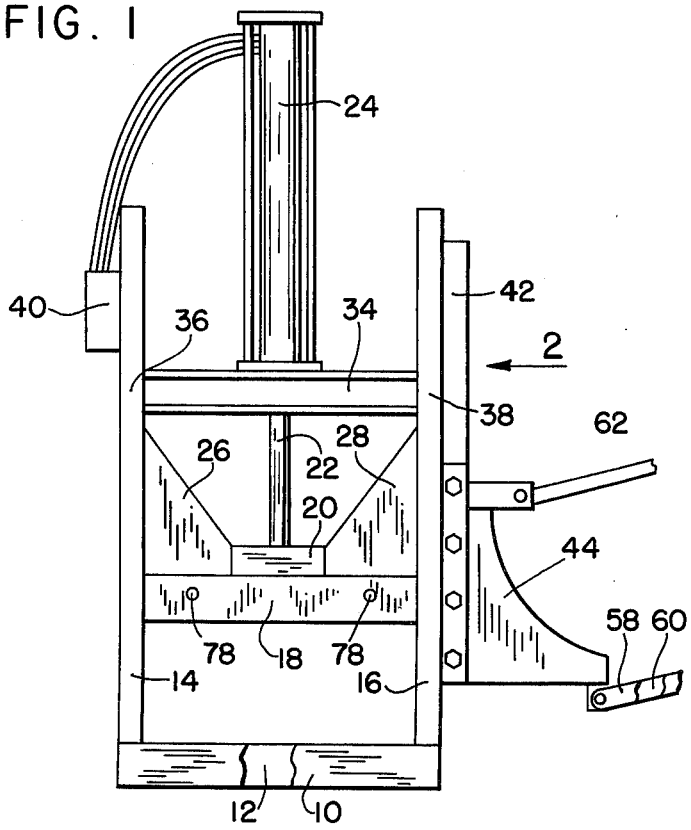
FIG. 1 is a view in front elevation of the splitter shown with an adapter for mounting the same on a tractor.
Figure 2:
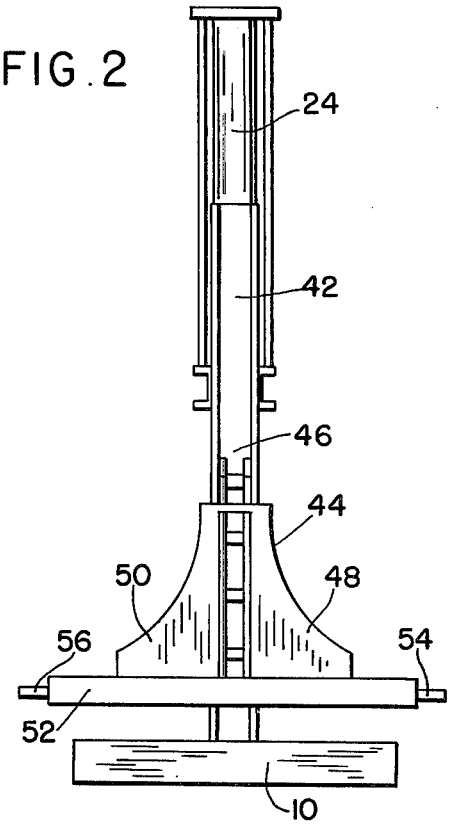
FIG. 2 is a view in elevation of the adapter per se looking in the direction of arrow 2 in FIG. 1.

The base of the splitter is a heavy built up box-like square base generally indicated at 10. This base is reenforced by various braces 12 extending across the same. At each side of the base opposite each other are a pair of channel irons 14, 16, the channels of these irons facing each other forming guideways for the blade assembly. The blade is indicated generally at 18 and extends across between the two channels the distance of e.g., in this case about 31 inches, almost 30 inches of which is available for splitting. It can be seen that a large section of log can be serviced having a diameter much greater than the opening between the channels 14, 16, because it can be split at the edge and then be turned for further splitting. The blade actually splits slices which are turned for group splitting into billets.

The blade is provided with a bracket 20 by which it is secured to the lower end of a piston rod or ram 22 of a hydraulic cylinder 24.

Figure 6:
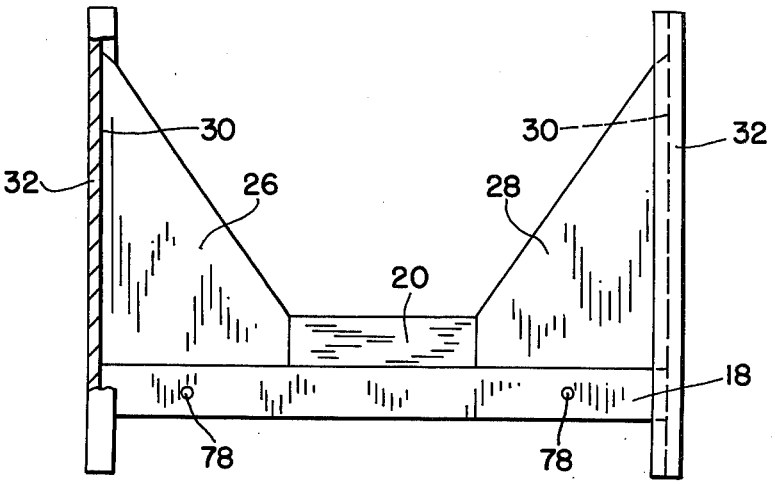
FIG. 6 is an enlarged front view of the blade assembly.

At each end of the blade 18 there are provided massive triangular guide wings 26 and 28 each of which has an elongated edge 30, secured in a channel 32, see FIG. 6, which slidingly fit and ride in the channels 14 and 16. These wings prevent any kind of wobble or tendency to bind because of the length of the wings which are e.g. 2 feet in length. Any extraneous force at any point inwardly on one guide is transferred through the blade, which is itself of massive dimensions, to the other wing, equalizing any tendency to bind due to a tendency to cock if such should occur.

Piston 24 is mounted on a double angle iron or the like 34 mounted in any way desired at its ends as at 36, 38 to the upright channel irons in fixed position relative thereto. Conventional hoses and controls, see control box 40, are conveniently mounted on the channel iron 14. On the channel iron 16 there is mounted another shorter channel iron 42 facing in the opposite direction and providing bolted-on supports for mounting the entire splitter directly on any kind of trailer or through a fixture or bracket generally indicated at 44 onto a tractor not shown of conventional design.

This bracket comprises a horizontal member 46 from which extend at angles thereto a pair of wings 48 and 50 at the lower ends of which is an iron cross bar 52 having pins 54 and 56 at the ends thereof for connection to linkages 58 and 60 of the tractor. The tractor has a linkage 62 whereby the device is held firmly into position as shown in FIG. 1. The bracket 44 is not needed with a trailer. The unit shown in FIG. 1 may be used without the bracket, with the base 10 merely set on the ground and operated by the hydraulic system of any vehicle or separate engine.

Also wheels may be applied to the base 10 for trailering operations and these wheels are easily removed to set the base 10 on the ground for operation.

Figure 3:
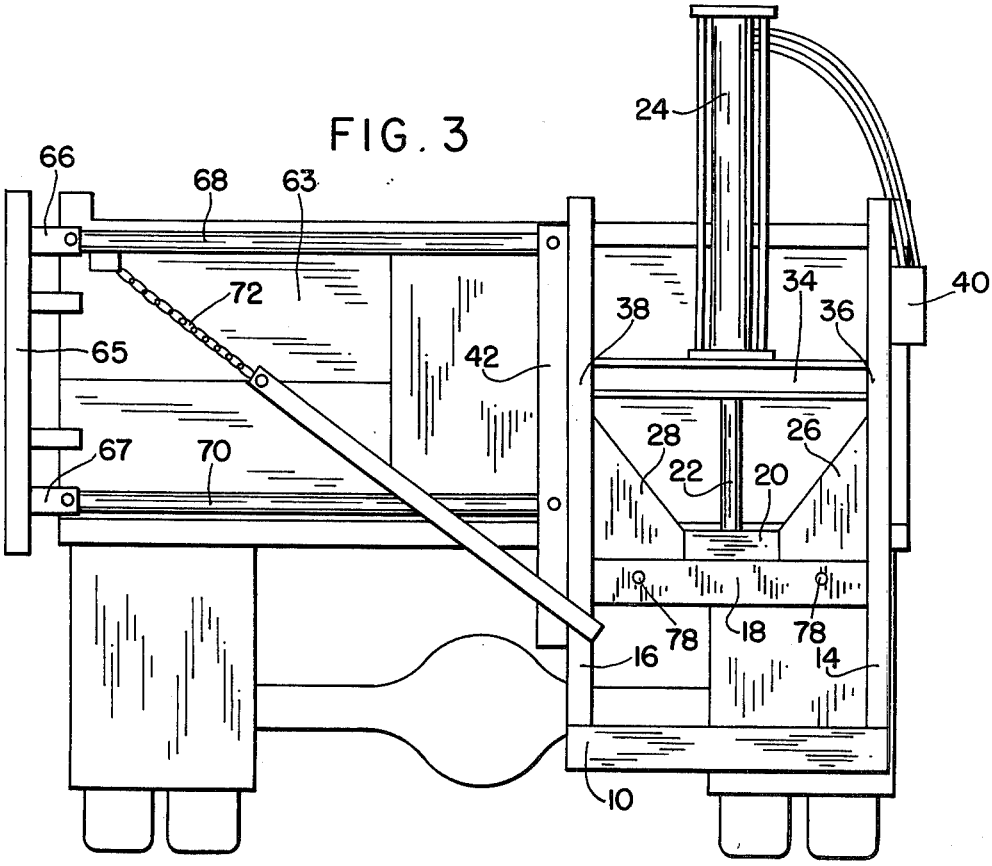
FIG. 3 is a view illustrating the splitter mounted on parallel bars on the rear of a truck.

Referring now to FIG. 3 there is here shown e.g., the rear panel 63 of a dump truck on one side of which there is mounted an upright spindle or the like 65 having brackets 66, 67 pivotally mounted parallel bars 68 and 70 which are pivoted with respect to the channel iron 42, and the splitter as shown in FIG. 3 is exactly the same as the one shown in FIG. 1 but without the bracket 44.

Figure 4:
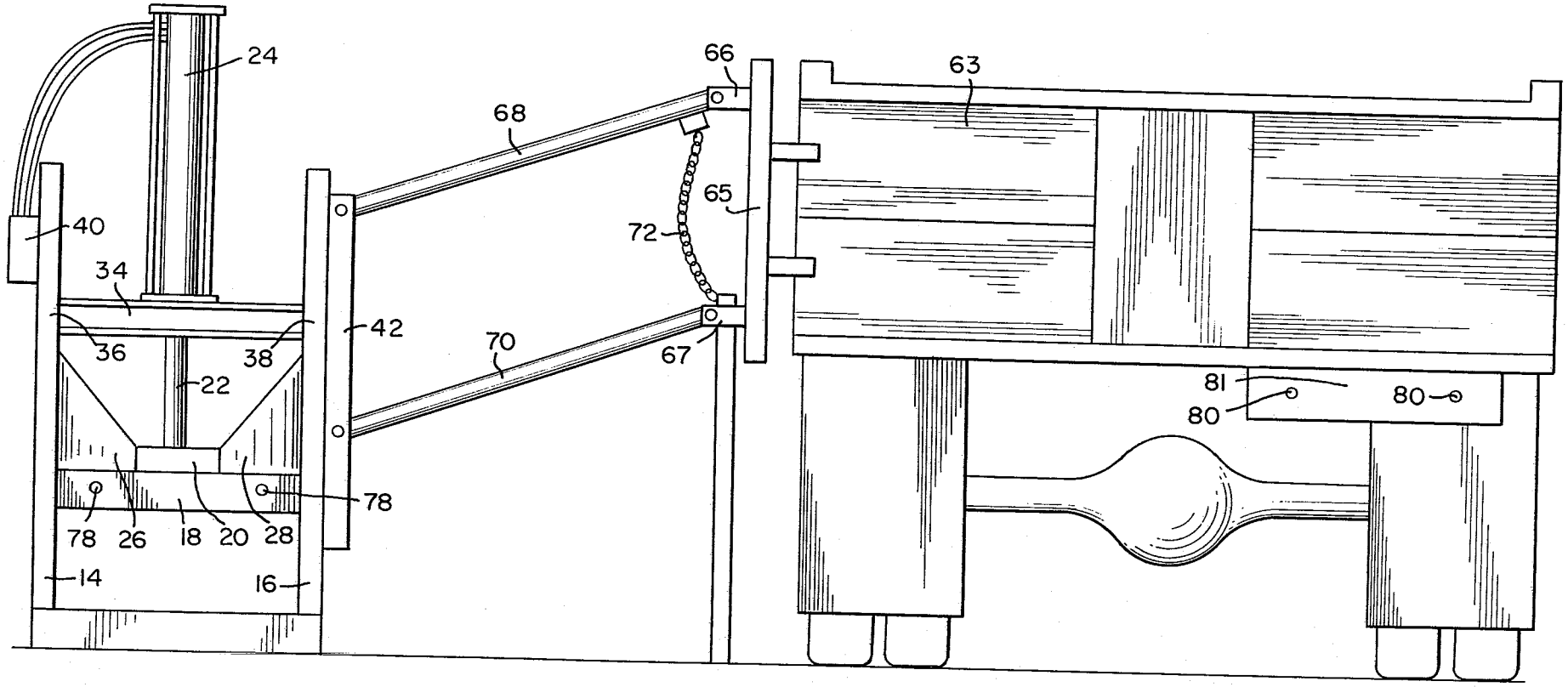
FIG. 4 is a view of the same apparatus showing the splitter in operation.

As shown in FIG. 4 the parallel bars can be used to swing the entire splitter down onto the ground or it can be easily raised and held in position by a link 72 for transportation purposes being latched down by any desired means. It will be noted that the spindle 65 is outboard of the truck body at the corner of the back and side thereof, and this means that the entire parallelogram with splitter attached can be swung around 270° and can be used anywhere on the ground in that arc. Also the dump truck panel can be lowered and the truck dumped with the entire apparatus swing 180° to 270° away from the position shown in FIG. 3, completely out of the way of the panel 63.

Figure 5:
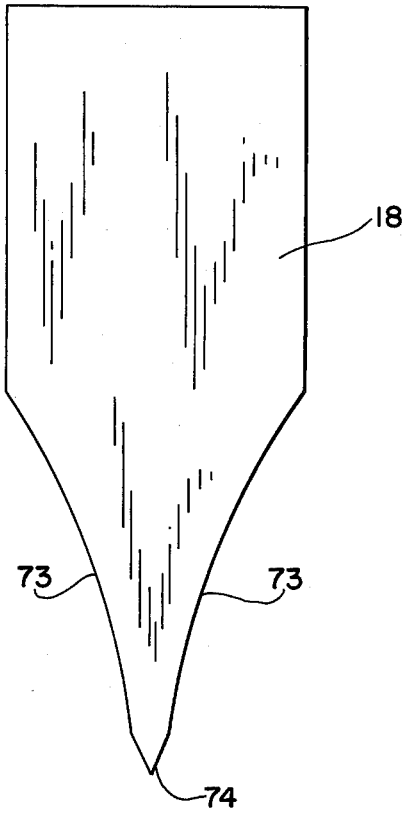
FIG. 5 is an end view of the blade.

The blade is massive as shown in FIG. 5 and comprises a bar hollow ground at 73, 73 forming a wide splitting wedge. The striking edge 74 is flat-sided but also forms a wide wedge for the best splitting action.

The characteristics of this log splitter are very simple but rugged and it has an enormous and very fast capacity for its intended purpose.

The blade has a pair of apertures 78, 78 therein for the reception of pins 80, 80, extending rearwardly from the rear of truck or other vehicle shown in rear view in FIG. 4. Pins 80, 80 may be on any part of the vehicle or on a plate 81 or the like. With base 10 on the ground behind the vehicle, the blade is raised to align the apertures 78 with pins 80, and the latter are thrust into the apertures. The ram has pressure applied to it, and the blade being now fixed, the base rises and can be locked in any way to hold it above ground, FIG. 3, for transportation.

Figure 7:
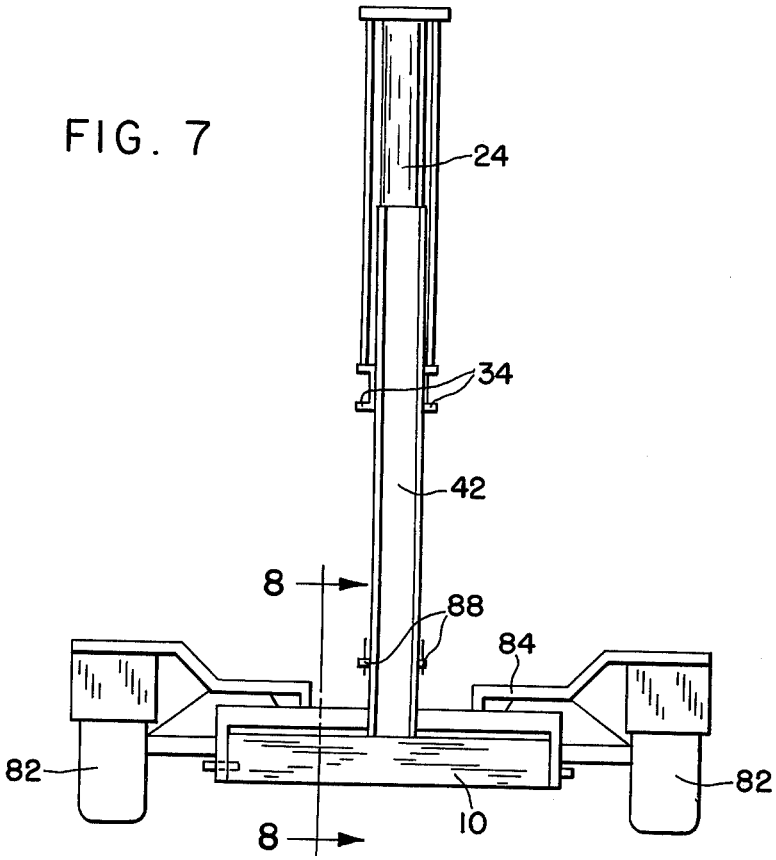
FIG. 7 is a view in elevation illustrating the trailer.
Figure 8:
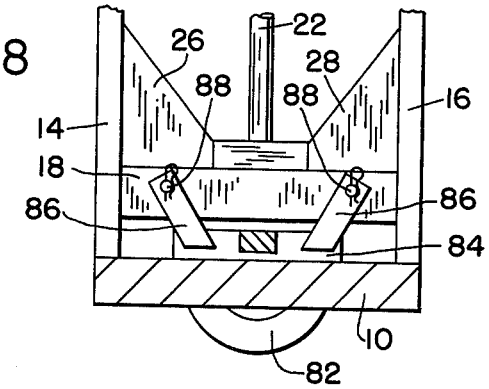
FIG. 8 is a section on line 8—8 of FIG. 7.

Trailer wheels 82, 82 on a frame 84 are used similarly. Plates 86, 86 fixed to frame 84 are fastened to blade 18 by pins 88, 88 taken into apertures 78, 78, with the frame 84 straddling the base 10. With the base on the ground, pressure is applied to the ram, and the base rises off the ground, FIGS. 7 and 8, to trailering position.

I claim:

1. A log splitter comprising a base, a pair of spaced standards thereon, each standard being located at an opposite edge of the base, a support joining the standards at a point spaced from the base, a sharpened splitting blade, said blade extending between the standards at the side of the support toward the base, the base, blade, and support all being parallel, a hydraulic cylinder on the support, a piston rod for the cylinder, means to supply fluid pressure to the cylinder to relatively extend said rod and said cylinder, means connecting the rod to the blade, means slidingly guiding the blade at its ends, said means including wings on the blade, said wings extending from the blade toward the support, and means on the wings sliding engaging the standards, including a wheeled frame, means to connect the blade to the frame with the blade spaced above the base, whereby pressure in the cylinder will raise the base relative to the frame.

2. The log splitter of claim 1 wherein the wheeled frame is a trailer.

3. The log splitter of claim 1 wherein the wheeled frame is a part of a vehicle.

* * * * *